US009345954B2

(12) United States Patent
Christensen, Jr.

(10) Patent No.: US 9,345,954 B2
(45) Date of Patent: May 24, 2016

(54) CRIBBAGE BOARD HAVING ILLUMINATING PEG HOLES

(71) Applicant: Richard James Christensen, Jr., Saint Michael, MN (US)

(72) Inventor: Richard James Christensen, Jr., Saint Michael, MN (US)

( * ) Notice: Subject to any disclaimer, the term of this patent is extended or adjusted under 35 U.S.C. 154(b) by 0 days.

(21) Appl. No.: 14/242,572

(22) Filed: Apr. 1, 2014

(65) Prior Publication Data

US 2015/0273318 A1 Oct. 1, 2015

(51) Int. Cl.

| | |
|---|---|
| ***A63F 13/00*** | (2014.01) |
| ***A63F 3/00*** | (2006.01) |
| ***A63F 9/24*** | (2006.01) |

(52) U.S. Cl.

CPC ..... *A63F 3/00643* (2013.01); *A63F 9/24* (2013.01); *A63F 2003/00646* (2013.01); *A63F 2003/00649* (2013.01); *A63F 2003/00652* (2013.01); *A63F 2003/00656* (2013.01); *A63F 2003/00659* (2013.01); *A63F 2009/2451* (2013.01); *A63F 2009/2452* (2013.01); *A63F 2009/2454* (2013.01)

(58) Field of Classification Search

CPC ..... A63F 2003/00649; A63F 2003/00652; A63F 2003/00656; A63F 2003/00659; A63F 2003/00646; A63F 2009/2451; A63F 2009/2452; A63F 2009/2454

USPC ..... 273/237, 238, 287, 260, 261

See application file for complete search history.

(56) References Cited

U.S. PATENT DOCUMENTS

| | | | | | |
|---|---|---|---|---|---|
| 2,670,208 | A * | 2/1954 | Wales | 273/237 |
| 3,189,888 | A * | 6/1965 | Bradley | 340/323 R |
| 3,579,856 | A * | 5/1971 | Way | 434/128 |
| 3,802,708 | A * | 4/1974 | Libert | 273/237 |
| 4,228,596 | A * | 10/1980 | Daniel | 434/344 |
| 4,552,362 | A * | 11/1985 | Oake | 273/237 |
| 4,616,832 | A * | 10/1986 | Groner | 273/238 |
| 5,328,187 | A * | 7/1994 | De Marchi | 273/237 |
| 5,848,788 | A * | 12/1998 | Hess | 273/239 |
| 2009/0322026 | A1 * | 12/2009 | Sun et al. | 273/238 |

FOREIGN PATENT DOCUMENTS

| | | |
|---|---|---|
| GB | 611601 | * 11/1948 |
| WO | WO8101766 | * 6/1981 |

* cited by examiner

*Primary Examiner* — Benjamin Layno

(57) ABSTRACT

A cribbage board having illuminating peg holes includes a discrete upper piece and a discrete lower piece. The top side of the upper piece includes a playing surface which is defined by a plurality of holes arranged as a first track and a second track, with each track including a continuous series of holes. The bottom side of the upper piece includes a plurality of distinct hollow channels, each running underneath a separate track of holes. In the hollow channels are a plurality of colored LEDs which illuminate when provided with electrical power. The LEDs are configured to illuminate underneath the first track of holes in a distinct color from the LEDs disposed underneath the second track of holes, so as to enable the different tracks of holes to be readily distinguished in a dark environment.

14 Claims, 7 Drawing Sheets

CRIBBAGE BOARD HAVING ILLUMINATING PEG HOLES

DETAILED DESCRIPTION OF THE INVENTION

Figure 1:
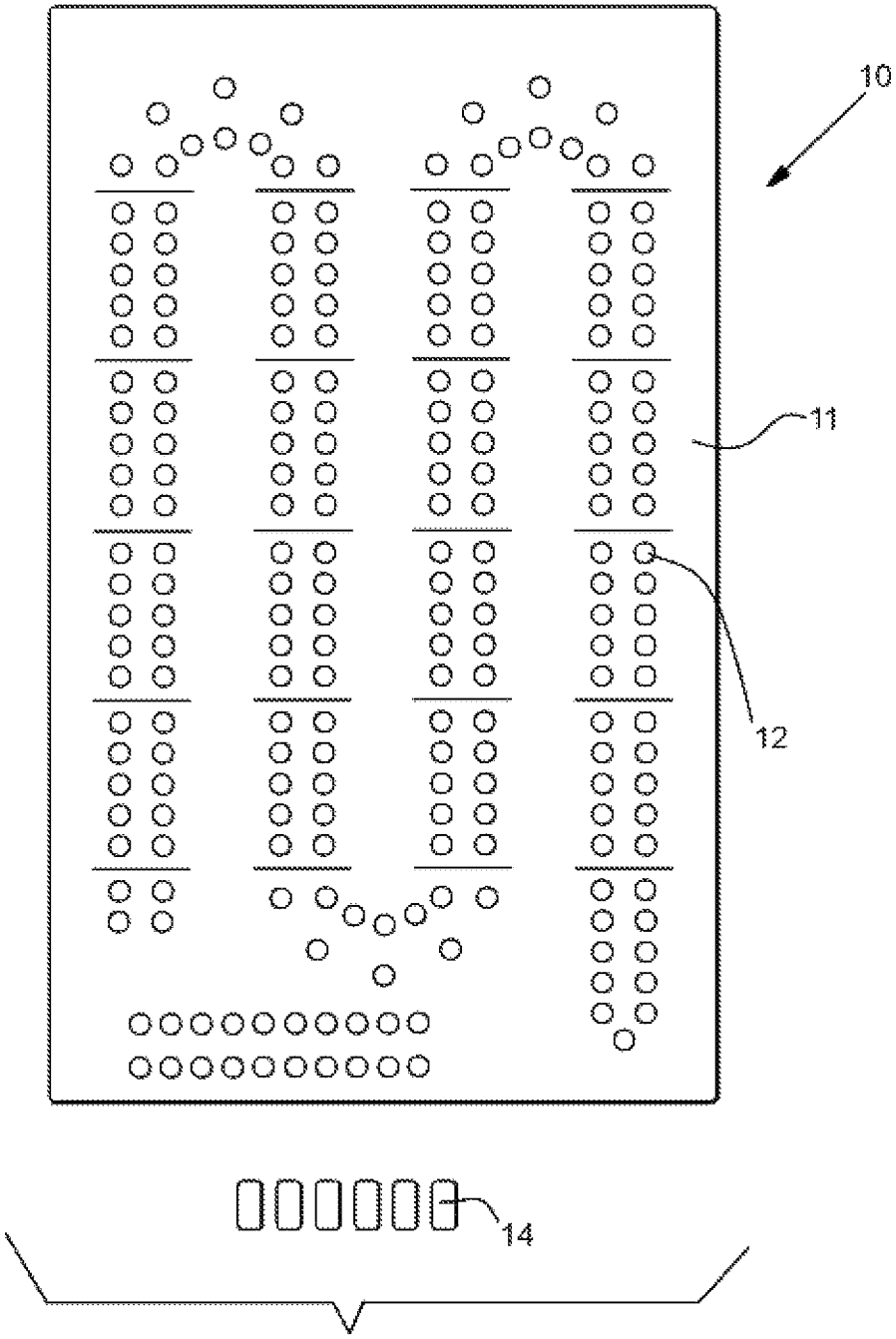
FIG. 1 is a top plan view of a cribbage board having illuminating peg holes and accompanying pegs built in accordance with the present invention.
Figure 2:
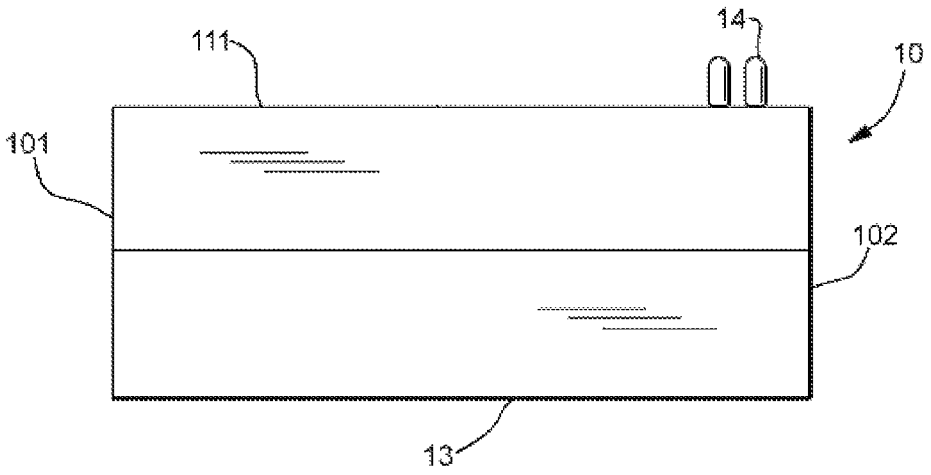
FIG. 2 is a side elevational view of a cribbage board having illuminating peg holes built in accordance with the present invention with a plurality of pegs disposed thereon.
Figure 3:
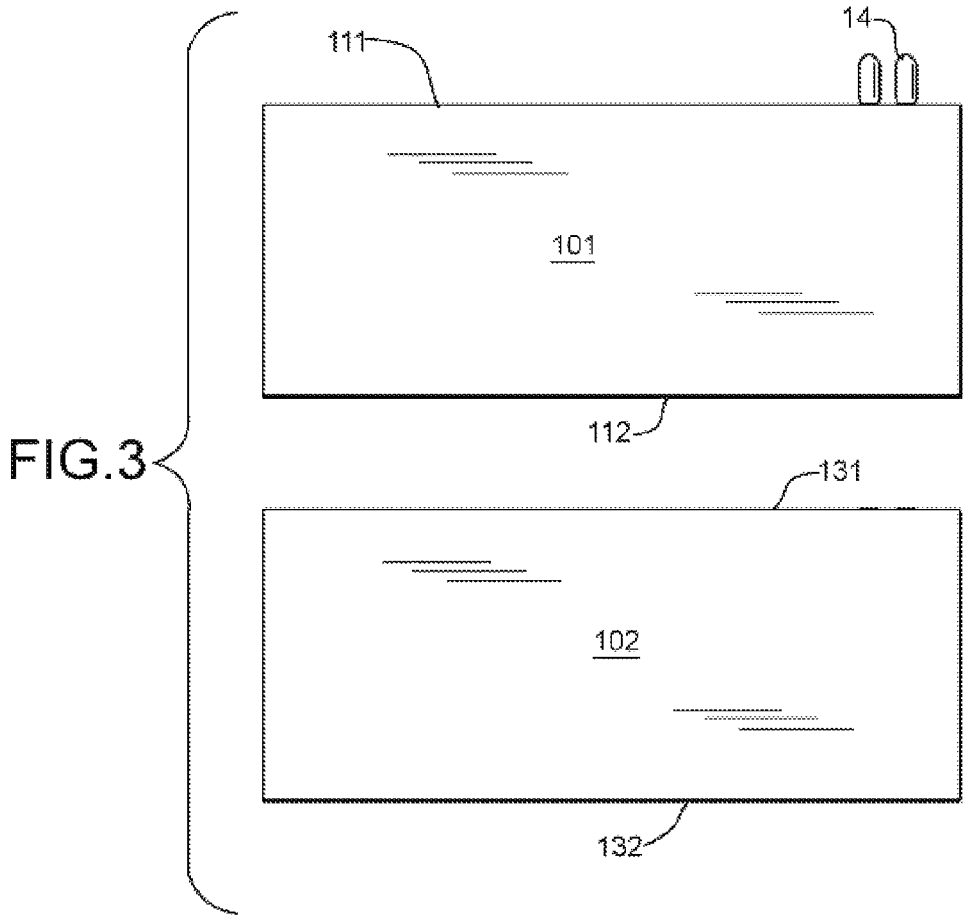
FIG. 3 is an exploded side elevational view of a cribbage board having illuminating peg holes built in accordance with the present invention with a plurality of pegs disposed thereon.

Referring now to the drawings and in particular FIGS. 1, 2 and 3, a cribbage board having illuminating peg holes 10 is shown having a discrete upper piece 101 and a discrete lower piece 102. In the preferred embodiment, the upper piece 101 is a wooden, rectangular body which includes on a top side 111 and a bottom side 112. In an alternate embodiment, the upper piece 101 may be substantially constructed of another rigid material, such as plastic or metal. The top side 111 includes a playing surface which embodies one conventional cribbage scorekeeping arrangement. In this regard, the playing surface is has a plurality of holes 12 arranged as a first track and a second track, with each track defined by a continuous series of holes 12, and two rows of including game counter holes 12. It is understood, however, that the present invention may be practiced with a playing surface 11 which embodies substantially any cribbage scorekeeping arrangement.

In the preferred embodiment, the lower piece 102 is a wooden, rectangular body having the same length and width as the upper piece 101 and which also includes on a top side

Figure 4A:
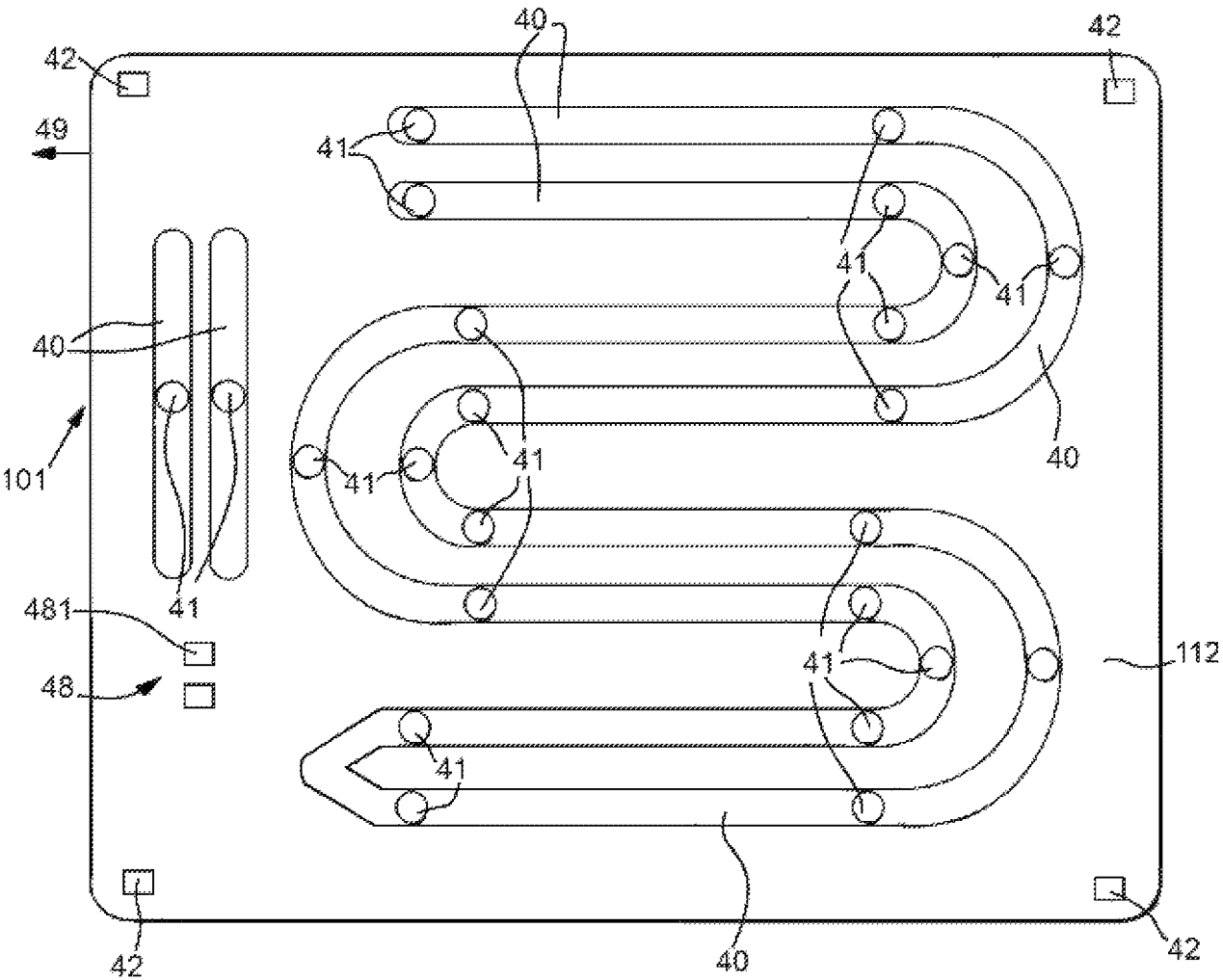
FIG. 4*a* is a bottom plan view of a cross section of the upper piece of a cribbage board having illuminating peg holes built in accordance with the present invention.
Figure 4B:
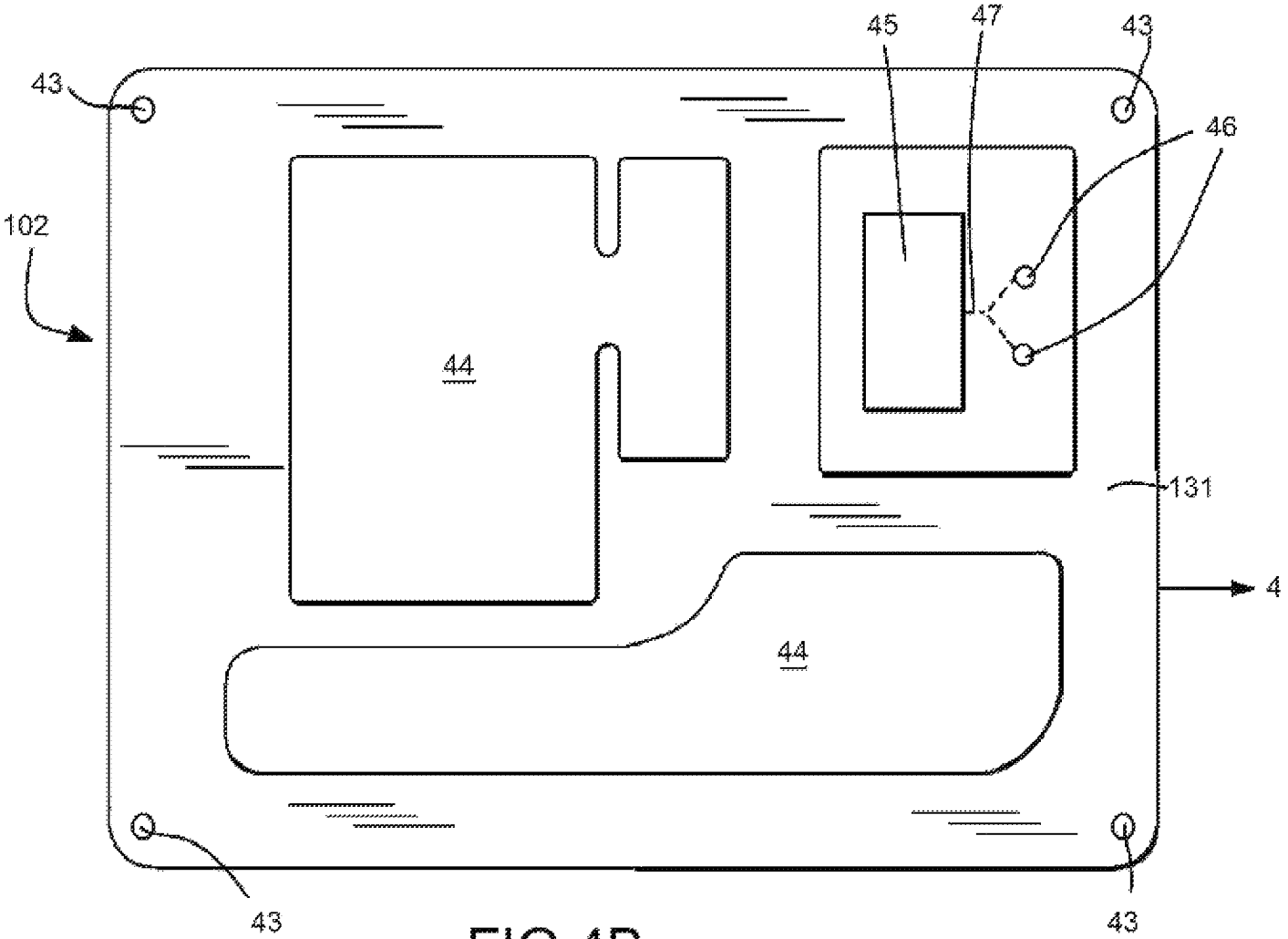
FIG. 4*b* is a top plan view of the lower piece of a cribbage board having illuminating peg holes built in accordance with the present invention.
Figure 5:
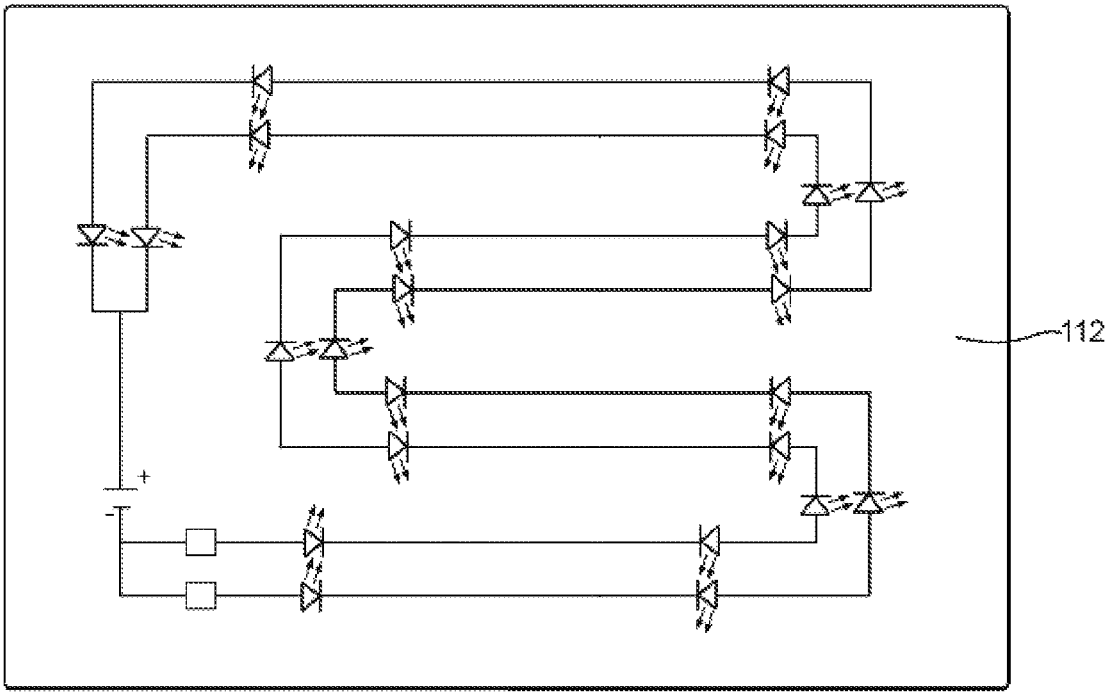
FIG. 5 is a bottom plan view of the electrical wiring of the upper piece of a cribbage board having illuminating peg holes built in accordance with the present invention
Figure 6:
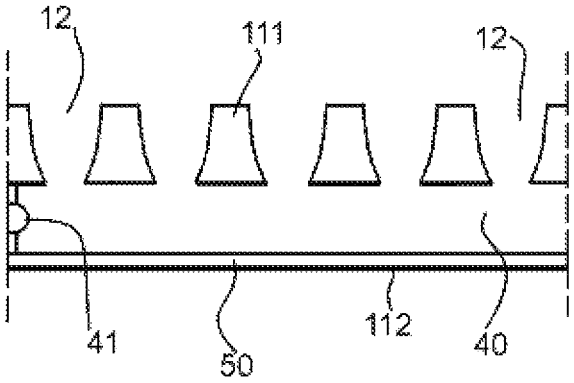
FIG. 6 is a partial side elevational view of a cross section of the upper piece of a cribbage board having illuminating peg holes built in accordance with the present invention.

131 and a bottom side 132. In an alternate embodiment, the lower piece 102 may be substantially constructed of another rigid material, such as plastic or metal. The top side 131 of the lower piece 102 and the bottom side 112 of the upper piece 101 are configured to be removable fastened together through a plurality of fastening magnets, as referenced in FIG. 4*a*, infra, to form the assembled cribbage board having illuminating peg holes 10. In an alternate embodiment, the lower piece 102 can be removably fastened to the upper piece 101 through an alternate fastening system, such as latch fastener or hook and loop fasteners. Due to the identical rectangular dimensions and the placement of the fastening interface, the lower piece 102 is configured such that may be fittedly secured to on the upper piece 101 in both a first orientation and a second orientation, with the second orientation representing a 180 degree rotation from the first orientation.

A plurality of pegs 14 sized to be removably placed in the holes 12 are included with the cribbage board having illuminating peg holes 10. The pegs 13 are constructed of a clear plastic material, defined in the preferred embodiment as acrylic. In an alternate embodiment, the pegs may be constructed out of another translucent or transparent material, such as plastic or glass. In any embodiment, the pegs 13, through their ability to allow light to pass through, are configured to illuminate when inserted in a hole 12 with any light which is being generated beneath that hole 12. By such configuration, when any peg 13 is disposed in an illuminated hole 12, the peg 13 appears to be illuminated.

Referring now to FIGS. 1, 4*a*, 4*b*, 5, 6, 7*a*, and 7*b*, the bottom side 112 of the upper piece 101 includes a plurality of hollow channels 40 disposed therein. Each hollow channel 40 is defined by a contiguous groove engraved in the wood material of the upper piece 101. It is contemplated, however, that the defining characteristic of the hollow channels 40 is their groove nature and thus, the hollow channels 40 may alternatively be grooves formed in any suitable way, such as from being machined, molded, or cut. Relative to the top side 111 of the upper piece 101, the hollow channels 40 form a continuous groove underneath the first track of holes 12, the second track of holes 12, and the rows of holes 12 forming the game counter.

Disposed in the hollow channels 40 are a plurality of lights 41. In the preferred embodiment, the lights 41 are colored LEDs which illuminate when provided with electrical power. It is contemplated that in the preferred embodiment, the lights 41 disposed in the hollow channel 40 underneath the first track of holes 12 are distinct in color from the lights disposed in the hollow channel 40 underneath the second track of holes 12, with the light 41 under each game counter row corresponding in color to the lights 41 under one of the tracks of holes 12, so as to enable the different tracks of holes 12 to be readily distinguished in a dark environment.

The two distinct hollow channels 40 meet underneath the winner peg hole, defined by the single peg hole at the end of both the first track of holes 12 and the second track of holes 12. As a result, the light from the first track of holes 12 and the second track of holes 12 combines underneath the winner peg hole and the light emanating from the winner peg hole is a third distinct color, representing the combination of the light from the first track of holes 12 and the second track of holes 12.

At the bottom of each hole 12 is a narrow passageway which enables light emanating from in the hollow channel 40 thereunder to pass into the hole 12. In order to increase the amount of light for passing through the holes 12 and suitably illuminate the holes 12 for cribbage scorekeeping in a dark environment, a plurality of lights 41 are disposed at various points in each hollow channel 40. In the preferred embodiment with a cribbage board having the scorekeeping arrangement shown in FIG. 1, a light 41 is disposed in substantially on each end of the hollow channels 40 and a light is disposed at the top of each of the semicircles formed by the hollow channels 40. In addition, a light 41 is disposed in the hollow channels 40 underneath the game counter rows.

Also improving the ability of the lights 41 to illuminate the holes 12 is a painted layer of chrome which covers the side walls of the hollow channels 40. The layer of chrome forms a reflective surface along the hollow channels 40, enabling light from the lights 41 to be more readily distributed throughout the hollow channels 40. It is understood that that being reflective is the defining characteristic of the walls of the hollow channels 40 and, as such, contemplated that the walls may alternatively be constructed or lined with a reflective substance, or constructed of a reflective substance.

The bottom side 112 of the upper piece 101 and the top side 131 of the lower piece 102 both include components of a magnetic fastening interface which enables the upper piece 101 and the lower piece 102 to be removable fastened together. The magnetic fastening interface includes a plurality of magnets 42, with one magnet 42 permanently attached to each corner of the bottom side 112 of the upper piece 101, and a plurality of metal bolts 43, with one bolt 43 permanently attached to each corner of the top side 131 of the lower piece 102. Fastening of the upper piece 101 to the lower piece 102 is achieved when the magnets 42 are aligned over the bolts 43, with the magnetic force from the magnets 42 creating a force that attracts the bolts 43, pulling them towards the magnets 42. The upper piece 101 may be removed from the lower piece 102 by manually rotating the upper piece 101 and/or lower piece 102 to cause the magnets 42 to no longer be aligned with the bolts 43.

Figure 7A:
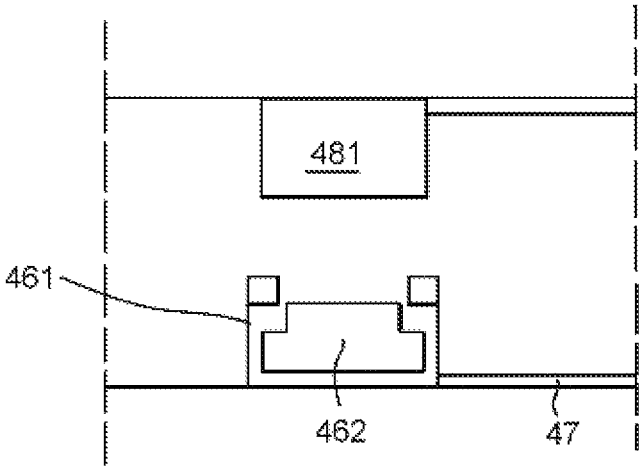
FIG. 7*a* is a partial side elevational view of a cross section of a power connector of a cribbage board having illuminating peg holes built in accordance with the present invention in the disconnected position.
Figure 7B:
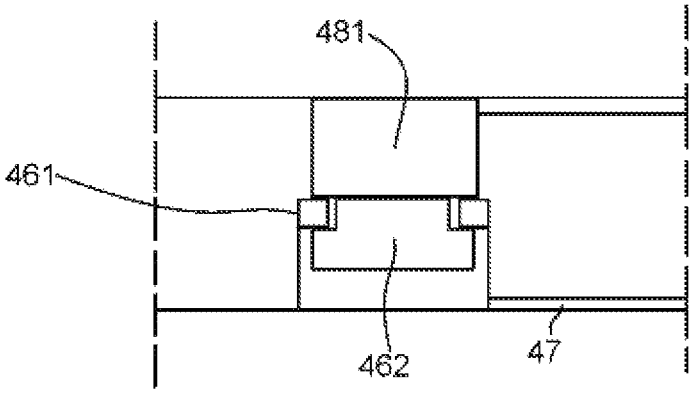
FIG. 7*b* is a partial side elevational view of a cross section of a power connector of a cribbage board having illuminating peg holes built in accordance with the present invention in the connected position.

The top side 131 of the lower piece 102 includes a plurality of storage channels 44 and the power source of the cribbage board having illuminating peg holes 10. The storage channels are defined as a depressions in the top side 131 in which materials can be placed into while not effecting the ability of the upper piece 101 to be fastened on the lower piece 102. The power source of the cribbage board having illuminating peg holes 10 includes a battery compartment 45 connected to a power connector 46 through electrical wiring 47. The power connector 46 includes two pin assemblies, each defined by a pin casing 461 and a pin 462 which movable between a disconnected position as shown in FIG. 7*a* and a connected position as shown in FIG. 7*b*. Because of gravity, the default position of the pin 462 is in the disconnected position. When a magnet is placed over the pin casing 461 however, the pin 462 will move to the connected position.

A power interface 48 disposed on the bottom side 112 of the upper piece 101 and includes two conductive magnets 481 which are connected to the lights 41 through electrical wiring. To enable the proper functioning of the LEDs, resistors are wired between the conductive magnets 481, providing a direct current interface, and the lights 41 wired as two parallel sets of six LEDs wired in series.

The power interface 48 is structured to engage the power connector 46 when the upper piece 101 is fastened to the lower piece 102 with the upper piece 101 and the lower piece 102 each arranged in an illuminating direction 49. The illuminating direction 49 is one of the possible orientations on which the lower piece 102 can be fittedly secured to on the upper piece 101. When the power interface 48 engages the power connector 46, the conductive magnets 481 are placed over the pin casings 461 and the magnetic force from the conductive magnets 481 move the pin 462 in each casing into the connected position, where they remain until the conductive magnets 481 are removed. In the connected position, an electrical circuit is completed between the battery compartment 45 and the power interface 48, resulting in the distribution of electrical power to the lights 41 and causing the same to illuminate. In this regard, when the upper piece 101 and the lower piece 102 are both arranged in the illuminating direction 49 and fastened together, electrical power from the battery compartment 45 is provided to the lights 41 and the holes 12 on the cribbage board having illuminating peg holes 10 illuminate from underneath. On the contrary, if upper piece 101 or lower piece 102 is rotated 180 degrees from the illuminating direction 49, or if they are otherwise fastened together in the opposite orientation with only one facing the illuminating direction 49, the upper piece 101 and lower piece 102 are fastened together without electrical power being provided to the lights 41 by way of the power interface 48.

In an alternate embodiment, the power interface 48 may be defined by two fixed corresponding electrical contacts, actuated when placed in frictional contact through a specific orientation of the components of the cribbage board having illuminating peg holes 10 or through a switching mechanism.

In an alternate embodiment, a base cover 50 is disposed on the bottom side 112 of the upper piece 101, enclosing the bottom of the hollow channels 40. In such an embodiment, the side of the base cover 50 adjacent to the hollow channels 40 is also covered with a layer of chrome paint.

Figure 8:
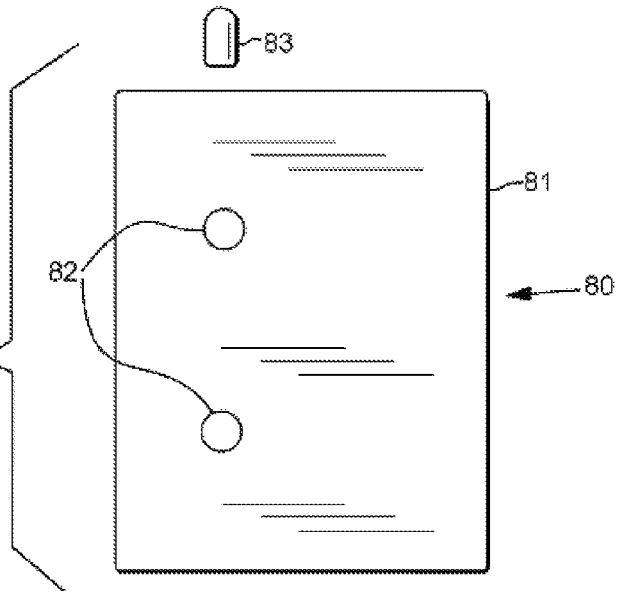
FIG. 8 is a top plan view of a board game board having illuminating peg holes and accompanying pegs built in accordance with the present invention.
Figure 9:
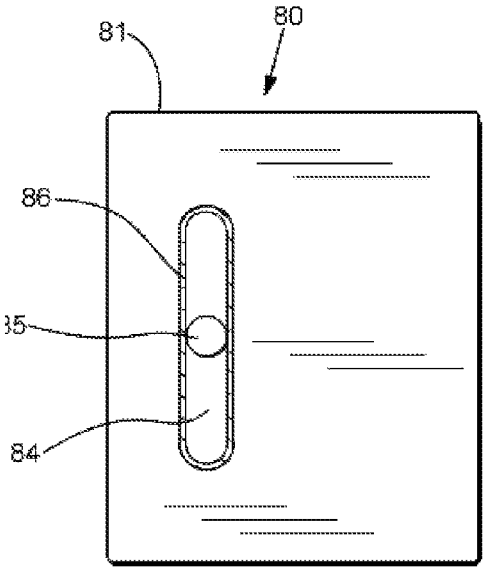
FIG. 9 is a bottom plan view of a cross section of the upper piece of a board game board having illuminating peg holes built in accordance with the present invention.
Figure 10:
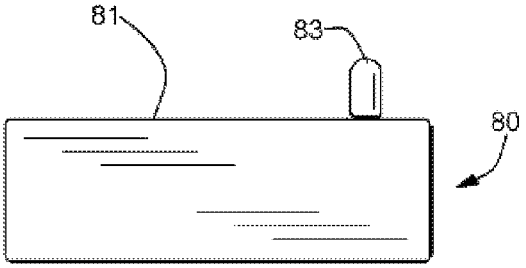
FIG. 10 is a side elevational view of a board game board having illuminating peg holes built in accordance with the present invention with a peg disposed thereon.

It is contemplated that to make the playing surface of any game board visible in darker environments, the implementation of hollow channels below the playing surface of the game board may be employed with any game board as long as the surface of a material or construction to enable light from below the surface to pass through. Referring now to FIG. 8, in an alternate embodiment of the present invention, an illuminated board game board 80 is defined by a board body 81 with two surface holes 82 and a peg 83 sized to be placed in either surface hole 82. Running underneath the surface holes 82 is a hollow channel 84 and an LED light 85. At the bottom of each hole 82 is a narrow passageway which enables light emanating from in the hollow channel 84 thereunder to pass into the hole 82. The walls 86 of the hollow channel 84 are defined by a reflective surface, enabling light from the LED light 85 to be more readily distributed throughout the hollow channels 84.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An illuminating board for playing a game, comprising: a game board having a playing surface with a plurality of discrete cavities and a power source;

said game board is defined by an upper and a lower piece releasable attached to each other;

said cavities have at least one light passing through; and a first set of at least one lights are disposed under the surface of said game board and a second set of at least one lights are disposed on said upper piece and lower piece, wherein at least one of lights passes through at least one of said cavities.

2. An illuminating board for playing a game, comprising:

a game board having a playing surface with a plurality of discrete cavities and a power source;

at least one hollow channel defined as a continuous groove in the game board underneath said playing surface; and a first set of at least one lights disposed in said at least one hollow channel and positioned such that light emitted from said first set of at least one lights passes through at least one of said cavities.

3. The illuminating board for playing a game of claim 2, wherein the game board includes a plurality of discrete hollow channels.

4. The illuminating board for playing a game of claim 2, additionally comprising a second set of at least one light disposed in at least one of said hollow channels and positioned such that light emitted from said second set of at least one lights passes through at least one of said, wherein no cavity has light from both the first set of at least one lights and the second set of at least one lights passing through.

5. The illuminating board for playing a game of claim 2, wherein the walls of said hollow channels are reflective.

6. The illuminating board for playing a game of claim 2, wherein said game board is defined by an upper piece and a lower piece configured to releasably attach to each other.

7. The illuminating board for playing a game of claim 6, wherein:

said cavities, said hollow channels, said first set of at least one lights and said second set of at least one lights are disposed on said upper piece.

8. The illuminating board for playing a game of claim 7, additionally comprising:

a power connector electrically connected to said power source;

a power interface electrically connected to said first set of lights and said second set of lights; and wherein electrical power from said power source is availed to said first set of lights and said second set of lights when said power interface contacts said power connector.

9. The illuminating board for playing a game of claim 7 wherein said power source is disposed on said lower piece.

10. A cribbage board having illuminating peg holes comprising:

a game board having a plurality of discrete cavities arranged in at least two distinct tracks and a power source;

a first set of at least one lights disposed on said game board underneath at least one of said cavities and positioned such that light emitted from said first set of at least one lights passes through any cavity under which the first set of at least one lights is disposed; and a first hollow channel and sidewalls defined as a continuous groove in the game board underneath one of said tracks of cavities, wherein said first set of at least one lights are disposed in said at least one hollow channel and light from said first set of at least one lights passes through all cavities in the track of cavities above the first hollow channel.

11. The cribbage board having illuminating peg holes of claim 10, additionally comprising a second hollow channel defined as a continuous groove in the game board underneath one of said tracks of cavities, wherein each track of cavities has no more than one hollow channel thereunder.

12. The cribbage board having illuminating peg holes of claim 11, additionally comprising a second set of at least one lights disposed in the second hollow channel and positioned such that light emitted from said second set of at least one lights passes through the cavities above the second hollow channel.

13. The cribbage board having illuminating peg holes of claim 10, wherein said game board is defined by an upper piece and a lower piece configured to releasably attach to each other.

14. The cribbage board having illuminating peg holes of claim 10 wherein the sidewalls of said hollow channels are reflective.

* * * * *